US007353814B2

(12) United States Patent
Hirowatari et al.

(10) Patent No.: US 7,353,814 B2
(45) Date of Patent: Apr. 8, 2008

(54) APPARATUS AND METHOD FOR CONTROLLING FUEL INJECTION OF INTERNAL COMBUSTION ENGINE, AND INTERNAL COMBUSTION ENGINE

(75) Inventors: Seiji Hirowatari, Toyota (JP); Masanao Idogawa, Toyota (JP); Masahiko Teraoka, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 29 days.

(21) Appl. No.: 11/299,677

(22) Filed: Dec. 13, 2005

(65) Prior Publication Data

US 2006/0130457 A1 Jun. 22, 2006

(30) Foreign Application Priority Data

Dec. 16, 2004 (JP) ..... 2004-364582

(51) Int. Cl.
*F02D 41/14* (2006.01)

(52) U.S. Cl. ..... 123/674

(58) Field of Classification Search ..... 123/674
See application file for complete search history.

(56) References Cited

U.S. PATENT DOCUMENTS 6,116,227 A * 9/2000 Yoshioka et al. ..... 123/674
6,182,647 B1 2/2001 Hori et al.
6,192,863 B1 * 2/2001 Takase ..... 123/456
6,230,699 B1 * 5/2001 Mitsutani ..... 123/674

FOREIGN PATENT DOCUMENTS

| | | |
|---|---|---|
| DE | 198 59 824 A1 | 7/1999 |
| EP | 1 469 182 A1 | 10/2004 |
| JP | A 60-022053 | 2/1985 |
| JP | A 63-189656 | 8/1988 |
| JP | A 01-110856 | 4/1989 |
| JP | A 2004-060613 | 2/2004 |

* cited by examiner

*Primary Examiner*—Erick Solis
(74) *Attorney, Agent, or Firm*—Oliff & Berridge, PLC

(57) ABSTRACT

An internal combustion engine has a fuel injection valve. To cause an actual air-fuel ratio of air-fuel mixture burned in the engine to be equal to a target value, an electronic control device corrects a fuel injection amount from the fuel injection valve using a feedback correction value. The feedback correction value is changed based on the actual air-fuel ratio. The electronic control device computes, as a safeguard value, a value of the feedback correction value that causes a fuel injection time, which is an instruction sent to the fuel injection valve, to be a permissible minimum time. When the fuel injection time is less than the permissible minimum time, the electronic control device limits the lowest value of the feedback correction value to the safeguard value. As a result, the actual air-fuel ratio is prevented from being rich.

17 Claims, 6 Drawing Sheets

Fig.4(a)
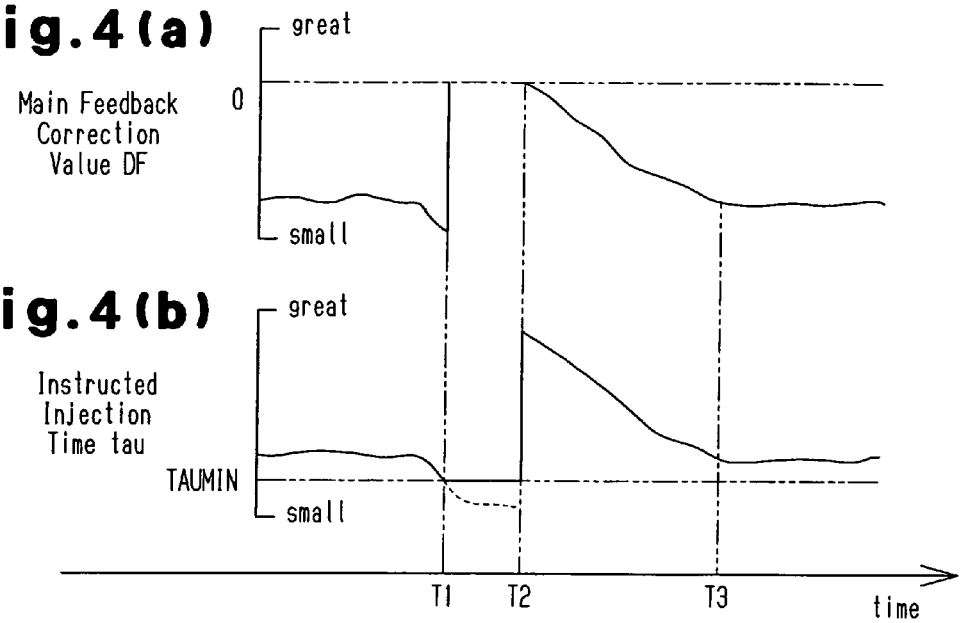
Fig.4(b)
Fig.5(a)
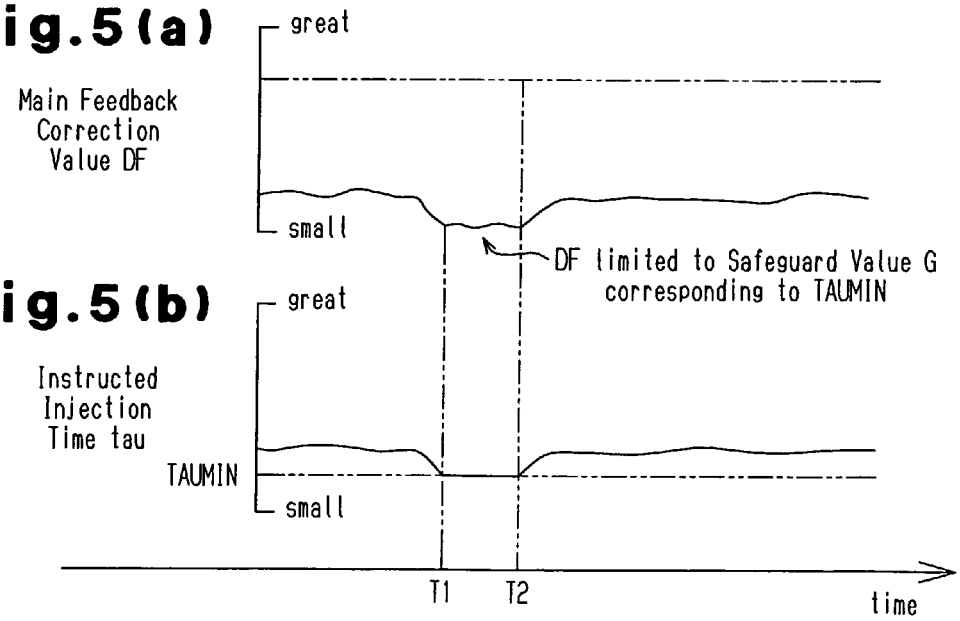
Fig.5(b)

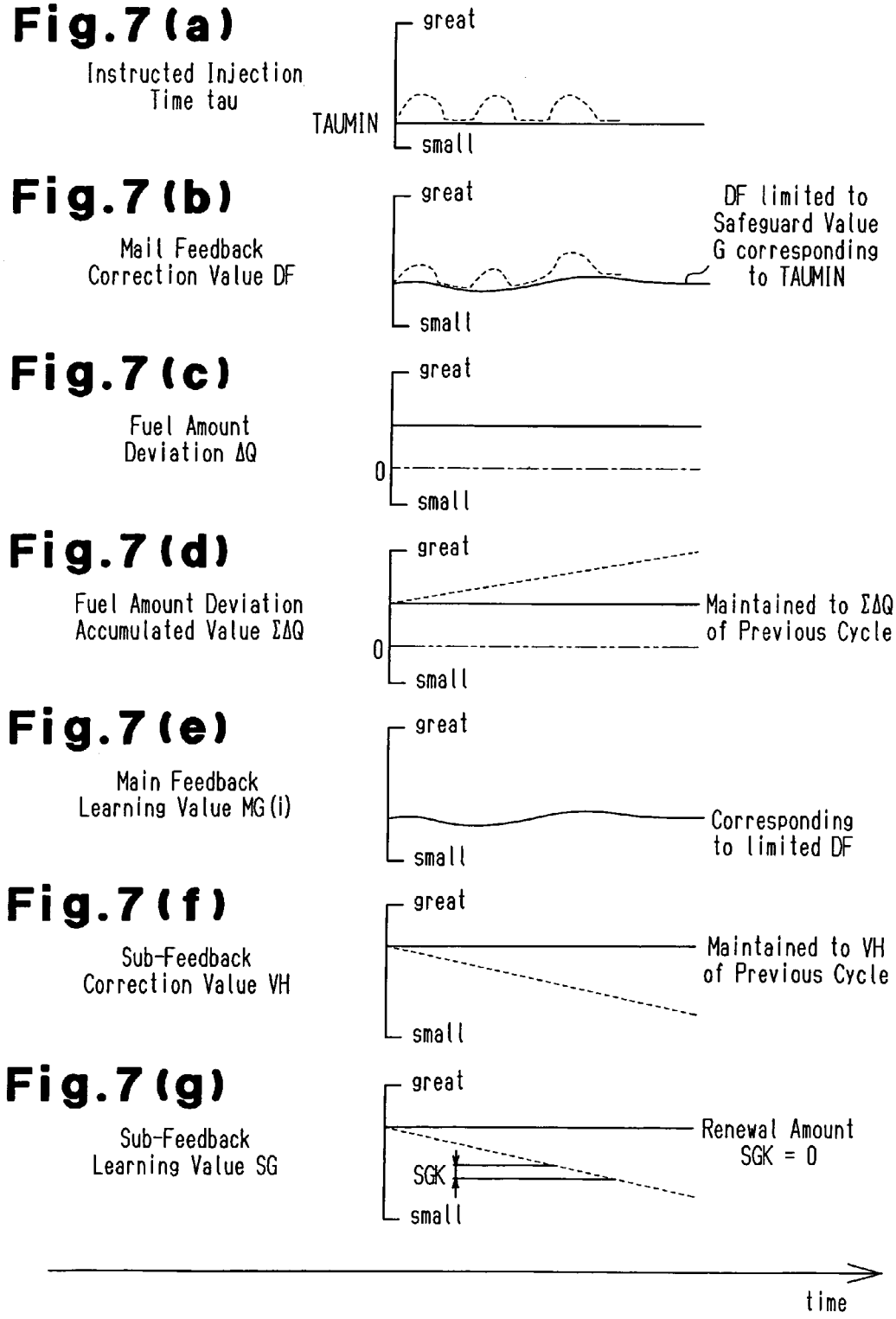
Fig.7(a)
Instructed Injection Time tau
great
TAUMIN
small
Fig.7(b)
Mail Feedback Correction Value DF
great
DF limited to Safeguard Value G corresponding to TAUMIN
small
Fig.7(c)
Fuel Amount Deviation ΔQ
great
0
small
Fig.7(d)
Fuel Amount Deviation Accumulated Value ΣΔQ
great
Maintained to ΣΔQ of Previous Cycle
0
small
Fig.7(e)
Main Feedback Learning Value MG(i)
great
Corresponding to limited DF
small
Fig.7(f)
Sub-Feedback Correction Value VH
great
Maintained to VH of Previous Cycle
small
Fig.7(g)
Sub-Feedback Learning Value SG
great
Renewal Amount SGK = 0
SGK
small
time

APPARATUS AND METHOD FOR CONTROLLING FUEL INJECTION OF INTERNAL COMBUSTION ENGINE, AND INTERNAL COMBUSTION ENGINE

BACKGROUND OF THE INVENTION

The present invention relates to an apparatus and a method for controlling fuel injection of an internal combustion engine, and to an internal combustion engine.

In an internal combustion engine such as an automobile engine, a catalytic converter having three-way catalysts is provided in an exhaust passage to purify exhaust gas. Specifically, the three-way catalysts oxidize CO and HC in exhaust gas and reduce NOx, thereby changing these into harmless $CO_2$, $H_2O$, $N_2$. Such purification of exhaust gas using three-way catalysts, that is, oxidation of CO, HC and reduction of NOx, are performed most effectively in a catalyst atmosphere of which the concentration of oxygen corresponds to that of combustion of air-fuel mixture at the stoichiometric air-fuel ratio.

Therefore, in the above described internal combustion engine, air-fuel ratio feedback control is performed in which the actual air-fuel ratio is set to the stoichiometric air-fuel ratio. In the air-fuel ratio feedback control, a feedback correction value that is used for correcting fuel injection amount is changed based on the actual air-fuel ratio such that the actual air-fuel ratio becomes equal to the stoichiometric air-fuel ratio.

That is, when the actual air-fuel ratio is leaner than the stoichiometric air-fuel ratio, the feedback correction value is increased as the actual air-fuel ratio becomes leaner. This increases the fuel injection amount so that the actual air-fuel ratio approaches the stoichiometric air-fuel ratio. Also, when the actual air-fuel ratio is richer than the stoichiometric air-fuel ratio, the feedback correction value is decreased as the actual air-fuel ratio becomes richer. This decreases the fuel injection amount so that the actual air-fuel ratio approaches the stoichiometric air-fuel ratio.

The fuel injection amount of an internal combustion engine is adjusted by changing the valve opening time (actuation time) of the fuel injection valve. The less the fuel injection amount, the shorter the actuation time of the fuel injection valve becomes. However, if the actuation time of the fuel injection valve is excessively short, changes in the fuel injection amount per unit time cannot be maintained constant in relation to changes in the valve opening time of the fuel injection valve per unit time due to the structural problems of the valve. The fuel injection thus becomes unstable.

Accordingly, Japanese Laid-Open Patent Publication No. 60-22053 discloses a technique in which, as a feedback correction value decreases and the actuation time of the fuel injection valve becomes less than a permissible value that permits the fuel injection valve to stably inject fuel, the feedback correction value is fixed to a reference value (initial value), so that the air-fuel ratio feedback control is stopped, and the actuation time of the fuel injection valve is set to the shortest permissible time. In this case, since the actuation time of the fuel injection valve does not stay less than the minimum permissible time, the accuracy of adjustment of the fuel injection amount is prevented from being degraded by unstable fuel injection from the fuel injection valve.

However, when the feedback correction value stays significantly less than the reference value, if the actuation time of the fuel injection valve is temporarily shorter than the permissible minimum time, and then reaches or surpasses the permissible minimum time immediately thereafter, the actual air-fuel ratio becomes rich. This inevitably degrades the emission and the combustion stability. The reason why the actual air-fuel ratio becomes rich under these circumstances will now be explained.

When the actuation time of the fuel injection valve is less than the permissible minimum time, the feedback correction value, which has been staying below the reference value, is fixed to the reference value. In other words, the correction value is increased significantly. At this time, since the actuation time of the fuel injection valve is set to the permissible minimum time regardless of the magnitude of the feedback correction value, the actual air-fuel ratio is not richened due to an excessive fuel injection amount when the feedback correction value is significantly increased as described above.

However, when the actuation time of the fuel injection valve reaches or surpasses the permissible minimum time immediately after the feedback correction value is fixed, the fixation of the actuation time of the fuel injection valve to the permissible minimum time is cancelled, and the actuation time is set to time that corresponds to the fuel injection amount that is adjusted using the feedback correction value. Since the fixation of the feedback correction value to the reference value has just been cancelled and the feedback correction value has just started being changed based on the air-fuel ratio, the feedback correction value is significantly greater than the value immediately before the fixation. Therefore, correction of the fuel injection amount based on the feedback correction value causes the actual air-fuel ratio to be richer than the stoichiometric air-fuel ratio.

Further, after the fixation is cancelled, the feedback correction value starts decreasing toward the value immediately before the fixation through changes based on the actual air-fuel ratio, such that the actual air-fuel ratio becomes equal to the stoichiometric air-fuel ratio. However, since the decrease of the feedback correction value starts from the reference value, the decrease of the correction value takes a long time until the actual air-fuel ratio becomes the stoichiometric air-fuel ratio. Until the time elapses, the actual air-fuel ratio inevitably stays richer than the stoichiometric air-fuel ratio.

SUMMARY OF THE INVENTION

Accordingly, it is an objective of the present invention to provide fuel injection control apparatus and method for an internal combustion engine, and an internal combustion engine, which are capable of, when the actuation time of a fuel injection valve reaches or surpasses a permissible minimum time immediately after being set less than the permissible minimum time, preventing the actual air-fuel ratio from being rich and adversely affecting the emission and the combustion state.

To achieve the foregoing and other objective of the present invention, an apparatus for controlling fuel injection of an internal combustion engine is provided. The engine has a fuel injection valve. To cause an actual air-fuel ratio of air-fuel mixture burned in the engine to be equal to a target value, the apparatus corrects a fuel injection amount from the fuel injection valve using a feedback correction value. The feedback correction value is changed based on the actual air-fuel ratio. The apparatus computes, as a limit value, a value of the feedback correction value that causes a fuel injection time, which is an instruction sent to the fuel injection valve, to be a permissible minimum time. When the fuel injection time is less than the permissible minimum time, the apparatus limits the lowest value of the feedback correction value to the limit value.

The present invention also provides an internal combustion engine including a combustion chamber, a fuel injection valve, and a controller. Air-fuel mixture is burned in the combustion chamber. The fuel injection valve injects fuel into the combustion chamber. To cause an actual air-fuel ratio of air-fuel mixture burned in the combustion chamber to be equal to a target value, the controller corrects a fuel injection amount from the fuel injection valve using a feedback correction value. The feedback correction value is changed based on the actual air-fuel ratio. The controller computes, as a limit value, a value of the feedback correction value that causes a fuel injection time, which is an instruction sent to the fuel injection valve, to be a permissible minimum time. When the fuel injection time is less than the permissible minimum time, the controller limits the lowest value of the feedback correction value to the limit value.

Further, the present invention provides a method for controlling fuel injection of an internal combustion engine. The engine has a fuel injection valve. The method includes: correcting a fuel injection amount from the fuel injection valve using a feedback correction value to cause an actual air-fuel ratio of air-fuel mixture burned in the engine to be equal to a target value, the feedback correction value being changed based on the actual air-fuel ratio; computing, as a limit value, a value of the feedback correction value that causes a fuel injection time, which is an instruction sent to the fuel injection valve, to be a permissible minimum time; and limiting the lowest value of the feedback correction value to the limit value when the fuel injection time is less than the permissible minimum time.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 4 is a time chart of prior art, in which section (a) shows changes in a main feedback correction value DF, and section (b) shows changes in an instructed injection time tau;

FIG. 5 is a time chart of the embodiment of FIG. 1, in which section (a) shows changes in the main feedback correction value DF, and section (b) shows changes in the instructed injection time tau;

FIG. 7 is a time chart showing the lower limit safeguard process for the main feedback correction value DF, in which section (a) shows changes in the instructed injection time tau, section (b) shows changes in the main feedback correction value DF, section (c) shows changes in a fuel amount deviation $\Delta Q$, section (d) shows changes in an accumulated value $\Sigma\Delta Q$ of the fuel amount deviation $\Delta Q$, section (e) shows changes in a main feedback learning value MG(i), section (f) shows changes in a sub-feedback correction value VH, and section (g) shows changes in a sub-feedback learning value SG.

DETAILED DESCRIPTION OF THE PREFERRED EMBODIMENTS

An embodiment of the present invention, which is applied to a vehicle direct-injection engine 1, will now be described with reference to FIGS. 1 to 8.

Figure 1:
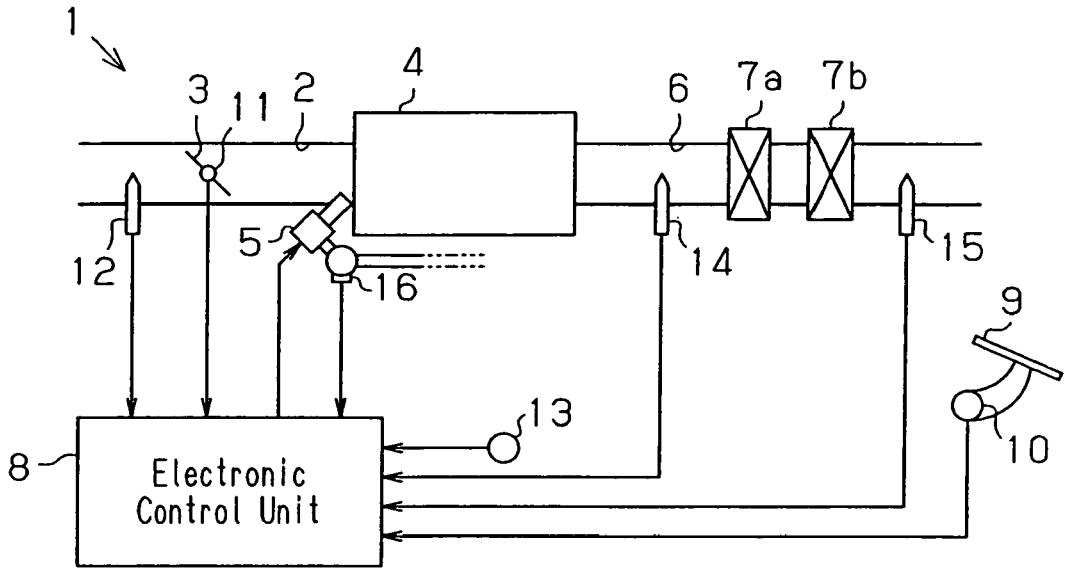
FIG. 1 is a diagrammatic view illustrating an entire engine to which a fuel injection control apparatus according to one embodiment is applied.

FIG. 1 shows the engine 1, in which the opening degree of a throttle valve 3 provided in an intake passage 2 is controlled to adjust the amount of air drawn into a combustion chamber 4. Air-fuel mixture of the drawn air and fuel injected from a fuel injection valve 5 is burned in the combustion chamber 4. After being burned, the air-fuel mixture is sent to an exhaust passage 6 as exhaust, and purified by three-way catalysts in catalytic converters 7*a*, 7*b* provided in the passage 6.

The three-way catalysts most effectively remove toxic components (HC, CO, NOx) from the exhaust when the concentration of oxygen in the catalysts is equal to the concentration of oxygen when air-fuel mixture at the stoichiometric air-fuel ratio is burned. Therefore, air-fuel ratio feedback control is performed in accordance with the oxygen concentration of exhaust for correcting the fuel injection amount such that the oxygen concentration in each catalyst stays in a predetermined range that includes values corresponding to the state when air-fuel mixture at the stoichiometric air-fuel ratio is burned.

The air-fuel ratio feedback control is performed by an electronic control unit 8 that is mounted on the vehicle to control the engine 1. The electronic control unit 8 controls the fuel injection valve 5 and receives detection signals from various types of sensors including:

a accelerator pedal position sensor 10 for detecting the depression degree of a accelerator pedal 9, which is operated when a driver of the vehicle depresses the accelerator pedal 9;

a throttle position sensor 11 for detecting the opening degree of the throttle valve 3;

an airflow meter 12 for detecting the flow rate of air drawn into the combustion chamber 4 through the intake passage 2 (intake air amount);

a crank position sensor 13, which sends signals corresponding to rotation of a crankshaft, which is an output shaft of the engine 1;

an air-fuel ratio sensor 14 for outputting linear detection signals according to the oxygen concentration of exhaust in a section upstream of the upstream catalytic converter 7*a;* an oxygen sensor 15 for outputting a rich signal or a lean signal according to the oxygen concentration of exhaust in a section downstream of the downstream catalytic converter 7*b*; and a fuel pressure sensor 16 for detecting the pressure of fuel supplied to the fuel injection valve 5.

Based on the engine operating state represented by, for example, the engine speed and the engine load ratio, the electronic control unit 8 computes a currently required fuel injection amount as an instructed injection amount Q, and actuates the fuel injection valve 5 to inject fuel the amount of which corresponds to the instructed injection amount Q. The engine speed is obtained based on the detection signal from the crank position sensor 13. Also, the engine load ratio represents the ratio of the current load to the maximum engine load and is computed based, for example, on a parameter corresponding to the intake air amount of the engine 1 and the engine speed. The parameter that corresponds to the intake air amount may be the accelerator pedal depression degree obtained from a detection signal of the accelerator pedal position sensor 10, the throttle opening degree obtained from a detection signal of the throttle position sensor 11, or an intake air amount obtained from a detection signal of the airflow meter 12.

When actuating the fuel injection valve 5 to inject fuel the amount of which corresponds to the instructed injection amount Q, instructed injection time is computed which is actuation time of the fuel injection valve 5 for injecting fuel the amount of which corresponds to the instructed injection amount Q. The fuel injection valve 5 is then excited (opened) for the instructed injection time tau. Accordingly, fuel the amount of which corresponds to the instructed injection amount Q is injected by the fuel injection valve 5. The instructed injection time tau, which is used for controlling the fuel injection valve 5, is computed using the following expression (1).

$$\text{tau}=Q\leftarrow K1\cdot\text{KINJA}+\text{KINJB} \quad (1)$$

tau: instructed injection time

Q: instructed injection amount

K1: fuel pressure correction coefficient

KINJA: sensitivity coefficient

KINJB: invalid injection time

The fuel pressure correction coefficient K1 in expression (1) is a coefficient that is changed according to the actual fuel pressure detected by the fuel pressure sensor 16 and is used for compensating for the influence of changes in the fuel injection amount due to changes in the fuel pressure supplied to the fuel injection valve 5. Specifically, when the actual fuel pressure is equal to a predetermined reference fuel pressure, the fuel pressure correction coefficient K1 is set to 1.0. As the actual fuel pressure becomes higher than the reference fuel pressure, the fuel pressure correction coefficient K1 is decreased from 1.0. As the actual fuel pressure becomes less than the reference fuel pressure, the fuel pressure correction coefficient K1 is increased from 1.0.

The sensitivity coefficient KINJA is a coefficient that corresponds to the sensitivity of the actual fuel injection amount to the excitation time of the fuel injection valve 5 (valve opening time). The invalid injection time KINJB represents a period during which fuel is not injected from the fuel injection valve 5 even in the excitation time, for example, at an initial stage of the excitation time of the fuel injection valve 5.

Next, the procedure for computing the instructed injection amount Q used in expression (1) will be described.

The instructed injection amount Q is computed using the following expression (2) based on a base fuel injection amount Qbase, a main feedback correction amount DF, and a main feedback learning value MG(i).

$$Q=\text{Qbase}+DF+MG(i) \quad (2)$$

Q: instructed injection amount

Qbase: base fuel injection amount

DF: main feedback correction value

MG(i): main feedback learning value

The base fuel injection amount Qbase is a theoretical fuel injection amount required for obtaining the air-fuel mixture at the stoichiometric air-fuel ratio, and is computed based on the intake air amount GA obtained based on a detection signal of the airflow meter and the stoichiometric air-fuel ratio 14.7 through expression (3) (Qbase=GA/14.7).

The main feedback correction value DF is used for correcting the fuel injection amount (the base fuel injection amount Qbase), and is changed based on the actual air-fuel ratio of the engine 1 obtained from a detection signal of the air-fuel ratio sensor 14 such that the actual air-fuel ratio of the engine 1 becomes the stoichiometric air-fuel ratio (target value). Through such changes in the main feedback correction value DF, the instructed injection time tau as well as the instructed injection amount Q is changed such that the actual air-fuel ratio of the engine 1 becomes the stoichiometric air-fuel ratio. In this manner, main feedback control for causing the actual air-fuel ratio to be equal to stoichiometric air-fuel ratio is performed.

Like the main feedback correction value DF, the main feedback learning value MG(i) is used for correcting the fuel injection amount (the base fuel injection amount Qbase), and is renewed to a value that compensates for constant deviation of the air-fuel ratio of the engine 1 from the stoichiometric air-fuel ratio caused by clogging of the intake system and the fuel injection system of the engine 1. The main feedback learning value MG(i) is renewed based on the main feedback correction value DF. Main feedback learning control is performed through the correction of the fuel injection amount using the main feedback learning value MG(i) and the main feedback correction value DF, and the renewal of the main feedback learning value MG(i). In the main feedback learning control, the learning value MG(i) is set to a value that corresponds to the constant deviation.

Next, a procedure for computing the main feedback correction value DF in the main feedback control and a procedure for renewing the main feedback learning value MG(i) in the main feedback learning control will be described individually.

[Computation of Main Feedback Correction Value DF]

The main feedback correction value DF is computed using the following expression (4) based on a fuel amount deviation ΔQ, a proportionality gain Gp, a fuel amount deviation accumulated value ΣΔQ, and an integration gain Gi.

$$DF=\Delta Q-Gp+\Sigma\Delta Q\cdot Gi \quad (4)$$

DF: feedback correction value

AQ: fuel amount deviation

Gp: proportionality gain (a negative value)

ΣΔQ: fuel amount deviation accumulated value

Gi: integration gain (a negative value)

The term ΔQ·Gp of the right side of expression (4) is a proportional term the magnitude of which is proportionate to the deviation of the actual air-fuel ratio from the stoichiometric air-fuel ratio. The fuel injection amount is changed by the amount that corresponds to the deviation such that the actual air-fuel ratio approaches the stoichiometric air-fuel ratio.

The fuel amount deviation ΔQ used in the proportional term ΔQ·Gp is a value obtained by subtracting a theoretical fuel amount required for obtaining the air-fuel mixture at the stoichiometric air-fuel ratio from the actually injected fuel amount. The fuel amount deviation ΔQ is computed based on the intake air amount GA, the actual air-fuel ratio ABF, and the base fuel injection amount Qbase, using expression (5) (ΔQ=(GA/ABF)−Qbase). The actual air-fuel ratio ABF is computed based on output VAF of the air-fuel ratio sensor 14 using expression (6) (ABF=g(VAF)).

Figure 2:
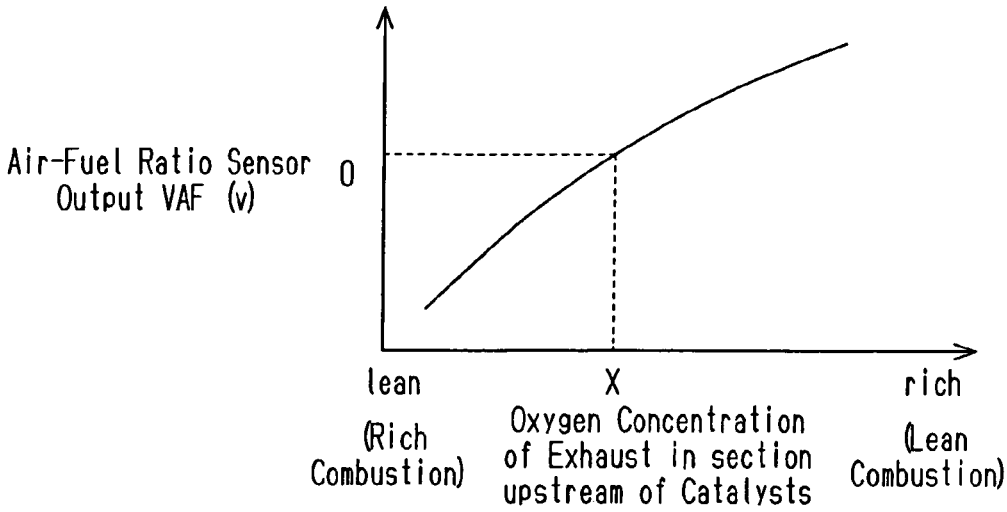
FIG. 2 is a graph showing the relationship between the concentration of oxygen in exhaust in a section upstream of catalysts and the output of an air-fuel ratio sensor.

As shown in FIG. 2, the output VAF of the air-fuel ratio sensor 14 decreases as the oxygen concentration in the section upstream of the catalysts decreases. When air-fuel mixture is burned at the stoichiometric air-fuel ratio, the output VAF becomes, for example, 0v in accordance with the oxygen concentration X in the exhaust. Therefore, as the oxygen concentration of the exhaust in the section upstream of the catalysts decreases due to the combustion of rich air-fuel mixture (rich combustion), the output VAF of the air-fuel ratio sensor 14 has a value less than 0v. Also, as the oxygen concentration of the exhaust in the section upstream of the catalysts increases due to the combustion of lean air-fuel mixture (lean combustion), the output VAF of the air-fuel ratio sensor 14 has a value greater than 0v.

The proportionality gain Gp used in the proportional term ΔQ·Gp is a constant that has been obtained through experiments in advance, and is set to a negative value.

In expression (4), the term ΣΔQ·Gi of the right side is an integral term that is used for eliminating a remaining deviation between the actual air-fuel ratio and the stoichiometric air-fuel ratio that cannot be cancelled by changes in the fuel injection amount using the proportional term ΔQ·Gp. The term ΣΔQ·Gi is used for changing the fuel injection amount by an amount corresponding to the remaining deviation so that the actual air-fuel ratio becomes equal to the stoichiometric air-fuel ratio.

The fuel amount deviation accumulated value ΣΔQ used in the integral term ΣΔQ·Gi is a value obtained through accumulation process in which the fuel amount deviation ΔQ is accumulated at predetermined intervals. In the accumulation process, expression (7) (ΣΔQ←ΣΔQ of the previous cycle+ΔQ) is repeated at predetermined intervals. The integral gain Gi used in the integral term ΣΔQ·Gi is a constant that has been obtained through experiments in advance, and is set to a negative value.

Therefore, if the fuel amount that has been actually burned is too small so that the actual air-fuel ratio ABF is great (lean), the fuel amount deviation ΔQ computed by expression (5) is changed in the negative direction. Thus, the main feedback correction value DF computed by expression (4) is increased. In contrast, if the fuel amount that has been actually burned is excessive so that the actual air-fuel ratio ABF is small (rich), the fuel amount deviation ΔQ is changed in the positive direction. Thus, the main feedback correction value DF is decreased.

As described above, the main feedback correction value DF is changed based on the actual air-fuel ratio ABF, and the instructed injection amount Q (the instructed injection time tau) is changed, accordingly. Thus, the fuel injection amount of the engine 1 is adjusted such that the air-fuel ratio of the engine 1 becomes equal to the stoichiometric air-fuel ratio.

[Renewal of Main Feedback Learning Value MG(i)]

The main feedback learning value MG(i) is renewed when a feedback correction coefficient that is the ratio of the main feedback correction value DF to the base fuel injection amount Qbase is, for example, 1% or greater, and the main feedback correction value DF is stable. Specifically, based on expression (8) (MG(i)←the newest DF), the main feedback correction value DF at the time is set as the main feedback learning value MG(i) so that the learning value MG(i) is renewed.

Therefore, when the main feedback correction value DF is great, the main feedback learning value MG(i) is renewed to a greater value. Through the renewal of the instructed injection amount Q (the instructed injection time tau) to a greater value using the learning value MG(i), the fuel injection amount of the engine 1 is increased. Also, when the main feedback correction value DF is small, the main feedback learning value MG(i) is renewed to a smaller value. Through the renewal of the instructed injection amount Q (the instructed injection time tau) to a smaller value using the learning value MG(i), the fuel injection amount of the engine 1 is decreased.

The renewal of the main feedback learning value MG(i) and the correction of the fuel injection amount using the leaning value MG(i), the main feedback correction value DF is caused to approach 0. When the main feedback correction value DF has approached 0 by a certain degree and is stable, the main feedback learning value MG(i) has a value that corresponds to the constant deviation of the air-fuel ratio of the engine 1 from the stoichiometric air-fuel ratio caused by clogging of the intake system and the fuel injection system.

The main feedback learning value MG(i) is prepared for each of learning regions i (i=1, 2, 3 . . . ), each of which corresponds to an engine load region. A learning region i that corresponds to the operating state of the engine 1 changes as the operation state of the engine 1 changes. Accordingly, the renewed main feedback learning value MG(i) is changed to a value that corresponds to the learning region i after the change. In this manner, for each learning region i, the main feedback learning value MG(i) is renewed.

Next, sub-feedback control and sub-feedback learning control will be described. The sub-feedback control is executed for preventing the accuracy of the main feedback control from being degraded by variation and changes with time of output characteristics of the air-fuel ratio sensor 14. The sub-feedback learning control is executed for compensating for the constant deviation of the air-fuel ratio of the engine 1 from the stoichiometric air-fuel ratio caused by the air-fuel ratio sensor 14 and the catalysts.

In the sub-feedback control and the sub-feedback learning control, the main feedback correction value DF is corrected using a sub-feedback correction value VH and a sub-feedback learning value SG. Specifically, based on the following expression (9), the output VAF of the air-fuel ratio sensor 14 is corrected by using the sub-feedback correction value VH and the sub-feedback learning value SG. The main feedback correction value DF is computed using the corrected output VAF based on expressions (4) to (6). In this manner, the correction value DF is corrected using the correction value VH and the learning value SG.

$$\text{VAF} \leftarrow \text{the newest VAF} + \text{VH} + \text{SG} \tag{9}$$

VAF: output of air-fuel sensor

VH: sub-feedback correction value

SG: sub-feedback learning value

The sub-feedback correction value VH is changed according to the detection signal from the oxygen sensor 15 located in a section downstream of the catalysts. The instructed injection amount Q (the instructed injection time tau) is changed through the correction of the main feedback correction value DF by changes in the sub-feedback correction value VH. Accordingly, the sub-feedback control is executed for preventing the accuracy of the main feedback control from being degraded. The execution of the sub-feedback control causes the sub-feedback correction value VH to change to a value that prevents the accuracy of the main feedback control from being degraded.

The sub-feedback learning value SG is renewed based on the sub-feedback correction value VH such that the sub-feedback learning value SG becomes a value that compensates for the constant deviation of the air-fuel ratio of the engine 1 from the stoichiometric air-fuel ratio caused by the air-fuel ratio sensor 14 and the catalysts. Through the correction of the main feedback correction value DF using the sub-feedback correction value VH and the sub-feedback learning value SG, and the renewal of the sub-feedback learning value SG, the sub-feedback learning control is executed for compensating for the constant deviation of the air-fuel ratio of the engine 1 from the stoichiometric air-fuel ratio caused by the air-fuel ratio sensor 14 and the catalysts.

Next, a procedure for computing the sub-feedback correction value VH in the sub-feedback control and a procedure for renewing the sub-feedback learning value SG in the sub-feedback learning control will be described individually.

[Procedure for Computing Sub-Feedback Correction Value VH]

The sub-feedback correction value VH is computed using the following expression (10) based on a voltage deviation ΔV, a proportionality gain Kp, a voltage deviation accumulated value ΣΔV, an integration gain Ki, a voltage differential value dV, and a differential gain Kd.

$$VH=\Delta V\cdot Kp+\Sigma\Delta V\cdot Ki+dV\cdot Kd \quad (10)$$

VH: sub-feedback correction value
ΔV: voltage deviation
Kp: proportionality gain (a negative value)
ΣΔV: voltage deviation accumulated value
Ki: integration gain (a negative value)
dV: voltage differential value
Kd: differential gain (a negative value)

The term ΔV·Kp of the right side of expression (10) is a proportional term the magnitude of which is proportionate to the deviation of the actual oxygen concentration in the section downstream of the catalysts and the value corresponding to combustion at the stoichiometric air-fuel ratio. The main feedback correction value DF (output VAF) is changed by the amount that corresponds to the deviation such that the deviation approaches 0.

The voltage deviation ΔV used in the proportional term ΔV·Kp is a value obtained by subtracting a theoretical output (for example, 0.5v) when the air-fuel mixture at the stoichiometric air-fuel ratio is burned from the actual output VO of the oxygen sensor 15. The voltage deviation ΔV is computed based on expression (11) (ΔV=VO−0.5v).

Figure 3:
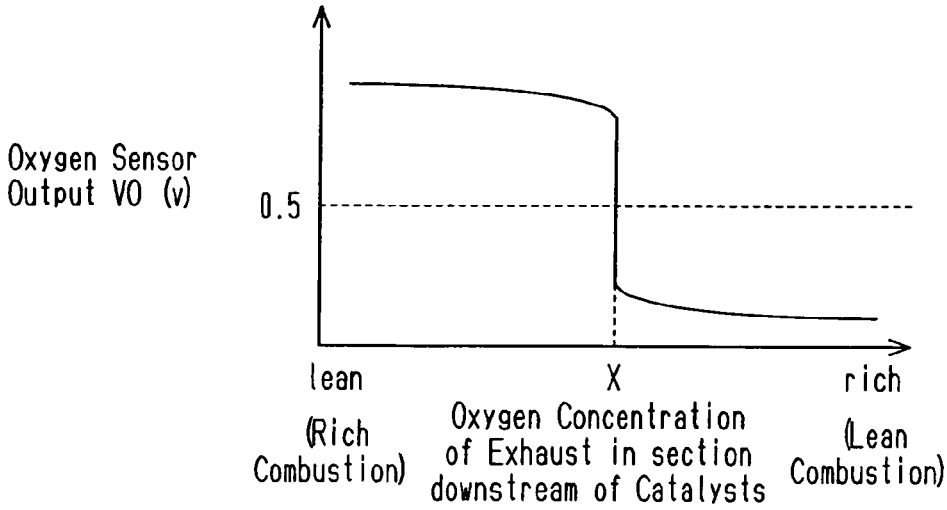
FIG. 3 is a graph showing the relationship between the concentration of oxygen in exhaust in a section downstream of the catalysts and the output of an oxygen sensor.

As shown in FIG. 3, the output VO of the oxygen sensor 15 has a value 0.5v when the oxygen concentration of exhaust in the section downstream of the catalysts has a value (oxygen concentration X) that corresponds to combustion of air-fuel mixture at the stoichiometric air-fuel ratio. When the oxygen concentration in the section downstream of the catalysts is higher than the oxygen concentration X due to, for example, the lean combustion, the oxygen sensor 15 outputs a value less than 0.5v as a lean signal. When the oxygen concentration in the section downstream of the catalysts is lower than the oxygen concentration X due to, for example, the rich combustion, the oxygen sensor 15 outputs a value greater than 0.5v as a rich signal.

The proportionality gain Kp used in the proportional term ΔV·Kp is a constant that has been obtained through experiments in advance, and is set to a negative value.

In expression (10), the term ΣΔV·Ki of the right side is an integral term that is used for eliminating a remaining deviation between the actual oxygen concentration in the section downstream of the catalysts and the value corresponding to the combustion at the stoichiometric air-fuel ratio, which deviation cannot be cancelled by changes in the main feedback correction value DF (output VAF) using the proportional term ΔV·Kp. The integral term ΣΔV·Ki becomes a value that corresponds to the remaining deviation, and the main feedback correction value DF (output VAF) is changed by the amount corresponding to the integral term ΣΔV·Ki, so that the actual value of the oxygen concentration in the section downstream of the catalysts matches with the value of the combustion at the stoichiometric air-fuel ratio.

The voltage deviation accumulated value ΣΔV used in the integral term ΣΔV·Ki is a value obtained through an accumulation process in which the voltage deviation ΔV is accumulated at predetermined intervals. In the accumulation process, expression (12) (ΣΔV←ΣΔV of the previous cycle+ΔV) is repeated at predetermined intervals. The integral gain Ki used in the integral term ΣΔV·Ki is a constant that has been obtained through experiments in advance, and is set to a negative value.

In expression (10), the term dV·Kd of the right side is a differential term that causes the difference between the actual value of the oxygen concentration in the section downstream of the catalysts and the value of the combustion at the stoichiometric air-fuel ratio to quickly converge to 0.

The voltage differential value dV used in the differential term dV·Kd is obtained by differentiating the output VO of the oxygen sensor 15 with respect to time, and represents the amount of change in the output VO per unit time. The differential gain Kd used in the differential term dV·Kd is a constant that has been obtained through experiments in advance, and is set to a negative value.

Therefore, if the oxygen concentration of exhaust in the section downstream of the catalysts is leaner than the value corresponding to the combustion at the stoichiometric air-fuel ratio (rich combustion), the voltage deviation ΔV computed by expression (11) is changed in the positive direction. Thus, the sub-feedback correction value VH computed by expression (10) is decreased. Contrastingly, if the oxygen concentration of exhaust in the section downstream of the catalysts is richer than the value corresponding to the combustion at the stoichiometric air-fuel ratio (lean combustion), the voltage deviation ΔV is changed in the negative direction. Thus, the sub-feedback correction value VH is increased.

As described above, the sub-feedback correction value VH is changed based on the oxygen concentration of exhaust in the section downstream of the catalysts, thereby correcting the main feedback correction value DF (output VAF). Accordingly, the accuracy of the main feedback control is prevented from being degraded by variation and changes with time of the output characteristics of the air-fuel ratio sensor 14.

[Procedure for Renewing Sub-Feedback Learning Value SG]

The sub-feedback learning value SG is renewed in the following manner. First, the newest sub-feedback correction value VH is subjected to smoothing process to compute a renewal amount SGK. The computed renewal amount is safeguarded from exceeding an upper limit and falling below a lower limit to obtain a renewal amount SGK. Based on the safeguarded value of the renewal amount SGK, the sub-feedback learning value SG is renewed using expression (13) (SG←SG of the previous cycle+SGK). That is, the renewal amount SGK after being safeguarded is added to the sub-feedback learning value SG of the previous cycle, thereby renewing the sub-feedback learning value SG.

Therefore, when the sub-feedback correction value VH is greater than 0, the sub-feedback learning value SG is renewed to be increased. Through the increasing correction of the main feedback correction value DF (output VAF) using the learning value SG, the fuel injection amount is increased. When the sub-feedback correction value VH is less than 0, the sub-feedback learning value SG is renewed to be decreased. Through the decreasing correction of the main feedback correction value DF (output VAF) using the learning value SG, the fuel injection amount is decreased.

The renewal of the sub-feedback learning value SG and the correction of the main feedback correction value DF using the leaning value SG, the sub-feedback correction value VH is caused to approach 0. When the sub-feedback correction value VH has approached 0 by a certain degree and is stable, the sub-feedback learning value SG has a value that corresponds to the constant deviation of the air-fuel ratio of the engine 1 from the stoichiometric air-fuel ratio caused by the air-fuel ratio sensor 14 and the catalysts.

While the main feedback control is being executed, if the operating state is shifted to an operating state in which the fuel injection amount is small, for example, idling or decelerating, and the fuel injection amount of the engine 1 is decreased due to decrease in the main feedback correction value DF, the instructed injection time tau can be excessively short. If the instructed injection time tau becomes too short, changes in the fuel injection amount per unit time cannot be maintained constant in relation to changes in the valve opening time of the fuel injection valve 5 per unit time due to the structural problems of the valve. The fuel injection thus becomes unstable.

Particularly, in the direct injection engine 1, to enable fuel injection into the high pressure combustion chamber 4, the pressure of fuel supplied to the fuel injection valve 5 is set to a high pressure. Accordingly, the fuel pressure correction coefficient K1 in expression (1) has a small value. This tends to shorten the instructed injection time tau relative to the instructed injection amount Q. In the direct injection engine 1, fuel injected into the combustion chamber 4 is likely to leak to the crankcase in a large amount. In the case where the engine 1 is provided with a blowby gas returning device for returning, together with blowby gas, fuel leaked to the crankcase to the intake passage 2, the instructed injection amount Q is decreased by the amount that corresponds to the fuel returned to the intake passage 2 through the main feedback control. This likely to shorten the instructed injection time tau.

Taking these factors into consideration, when the instructed injection time tau is less than permissible minimum time TAUMIN that allows the fuel injection valve 5 to stably inject fuel, the main feedback correction value DF may be fixed to 0, which is a reference value (initial value), thereby stopping the feedback control, so that the instructed injection time tau is set to the permissible minimum time TAUMIN. In this case, since the instructed injection time tau does not stay less than the permissible minimum time TAUMIN, disturbance of stable fuel injection from the fuel injection valve 5 is avoided.

However, when the main feedback correction value DF stays significantly less than the reference value (0), if the instructed injection time tau is temporarily shorter than the permissible minimum time TAUMIN, and then reaches or surpasses the permissible minimum time immediately thereafter, the air-fuel ratio of the engine 1 becomes rich. This degrades the emission and the combustion stability.

The reason why the actual air-fuel ratio becomes rich under these circumstances will now be explained with reference to a time chart of FIG. 4. In FIG. 4, section (a) shows changes in the main feedback correction value DF, and section (b) shows changes in the instructed injection time tau.

When the main feedback correction value DF stays significantly less than the reference value (0), if the instructed injection time tau becomes less than the permissible minimum time TAUMIN as represented by broken line in section (b) of FIG. 4 (time T1), the main feedback correction value DF is fixed to the reference value (0), as shown in section (a) of FIG. 4. This significantly increases the main feedback correction value DF. That is, the main feedback correction value DF is greatly changed to increase the fuel injection amount. At this time, since the instructed injection time tau is set to the permissible minimum time TAUMIN regardless of the magnitude of the main feedback correction value DF, the actual air-fuel ratio ABF is not richened due to excessive fuel injection amount in accordance with increase of the main feedback correction value DF.

However, if the instructed injection time tau reaches or surpasses the permissible minimum time TAUMIN (time T2) immediately after the main feedback correction value DF is fixed to the reference value (0), fixation of the instructed injection time tau to the permissible minimum time TAUMIN is cancelled, and the instructed injection time tau is determined based on the instructed injection amount Q, which is corrected using the correction value DF. At this time, since the fixation of the main feedback correction value DF to the reference value (0) has just been cancelled and the correction value DF has started being changed based on the actual air-fuel ratio ABF of the engine 1, the main feedback correction value DF is excessively greater in relation to a value immediately before being fixed to the reference value (0), that is, the value immediately before time T1 in the drawing. Therefore, if the instructed injection amount Q is corrected based on the main feedback correction value DF, the instructed injection time tau will be significantly greater than the value immediately before the fixation, and the actual air-fuel ratio ABF will become richer than the stoichiometric air-fuel ratio.

Further, after the fixation of the main feedback correction value DF to the reference value (0) is cancelled, the main feedback correction value DF starts gradually decreasing toward the value immediately before the fixation so that the actual air-fuel ratio ABF becomes the stoichiometric air-fuel ratio according to changes based on the actual air-fuel ratio ABF. Also, the instructed injection time tau is gradually decreased as the main feedback correction value DF decreases. However, since the main feedback correction value DF starts decreasing from the reference value (0), it takes relatively long time to decrease the correction value DF until the actual air-fuel ratio ABF becomes the stoichiometric air-fuel ratio. Therefore, until the required time elapses (from time T2 to time T3), the actual air-fuel ratio ABF inevitably stays richer than the stoichiometric air-fuel ratio.

As described above, if the actual air-fuel ratio ABF is richer than the stoichiometric air-fuel ratio at time T2 and in the period from time T2 to time T3, the actual air-fuel ratio ABF adversely affects the emission and the combustion stability.

To deal with such problems, a value of the main feedback correction value DF that permits the instructed injection time tau to be the permissible minimum time TAUMIN is set as a safeguard value G in this embodiment. When the instructed injection time tau becomes shorter than the permissible minimum time TAUMIN, the main feedback correction value DF is safeguarded from falling below the safeguard value G, so that the instructed injection time tau stays longer than the permissible minimum time TAUMIN.

In this case, if the instructed injection time tau reaches or surpasses the permissible minimum time TAUMIN immediately after being shorter than the permissible minimum time TAUMIN, the actual air-fuel ratio ABF is prevented from being rich, and thus does not adversely affect the emission and the combustion state. The reason for this will now be described with reference to the time chart of FIG. 5. In FIG. 5, section (a) shows changes in the main feedback correction value DF, and section (b) shows changes in the instructed injection time tau.

When the main feedback correction value DF stays significantly less than the reference value (0), if the instructed injection time tau becomes less than the permissible minimum time TAUMIN as represented by broken line in section (b) of FIG. 5 (time T1), the lower limit safeguard process for the main feedback correction value DF using the safeguard value G is executed as shown in section (a) of FIG. 5. Through this safeguard process, the instructed injection time tau is prevented from being shorter than the permissible minimum time TAUMIN.

Then, when the instructed injection time tau reaches or surpasses the permissible minimum time TAUMIN (time T2) immediately after being shorter than the permissible minimum time TAUMIN, the main feedback correction value DF starts being changed based on the actual air-fuel ratio ABF from the safeguard value G, but not from the reference value (0). Therefore, immediately after the lower limit safeguard process is cancelled (time T2), correction of the instructed injection amount Q based on the main feedback correction value DF prevents the actual air-fuel ratio ABF from being significantly richer than the stoichiometric air-fuel ratio. The starting point of changes in the main feedback correction value DF for causing the actual air-fuel ratio ABF to converge to the stoichiometric air-fuel ratio immediately after the lower limit safeguard process is cancelled is set to the safeguard value G, but not the reference value (0). Thus, the actual air-fuel ratio ABF is permitted to quickly converge to the stoichiometric air-fuel ratio through the changes, so that the actual air-fuel ratio ABF is prevented from being rich.

Accordingly, even if the instructed injection time tau reaches or surpasses the permissible minimum time TAUMIN immediately after being shorter than the permissible minimum time TAUMIN, the actual air-fuel ratio ABF is prevented from being rich, and thus does not adversely affect the emission and the combustion state.

Figure 6:
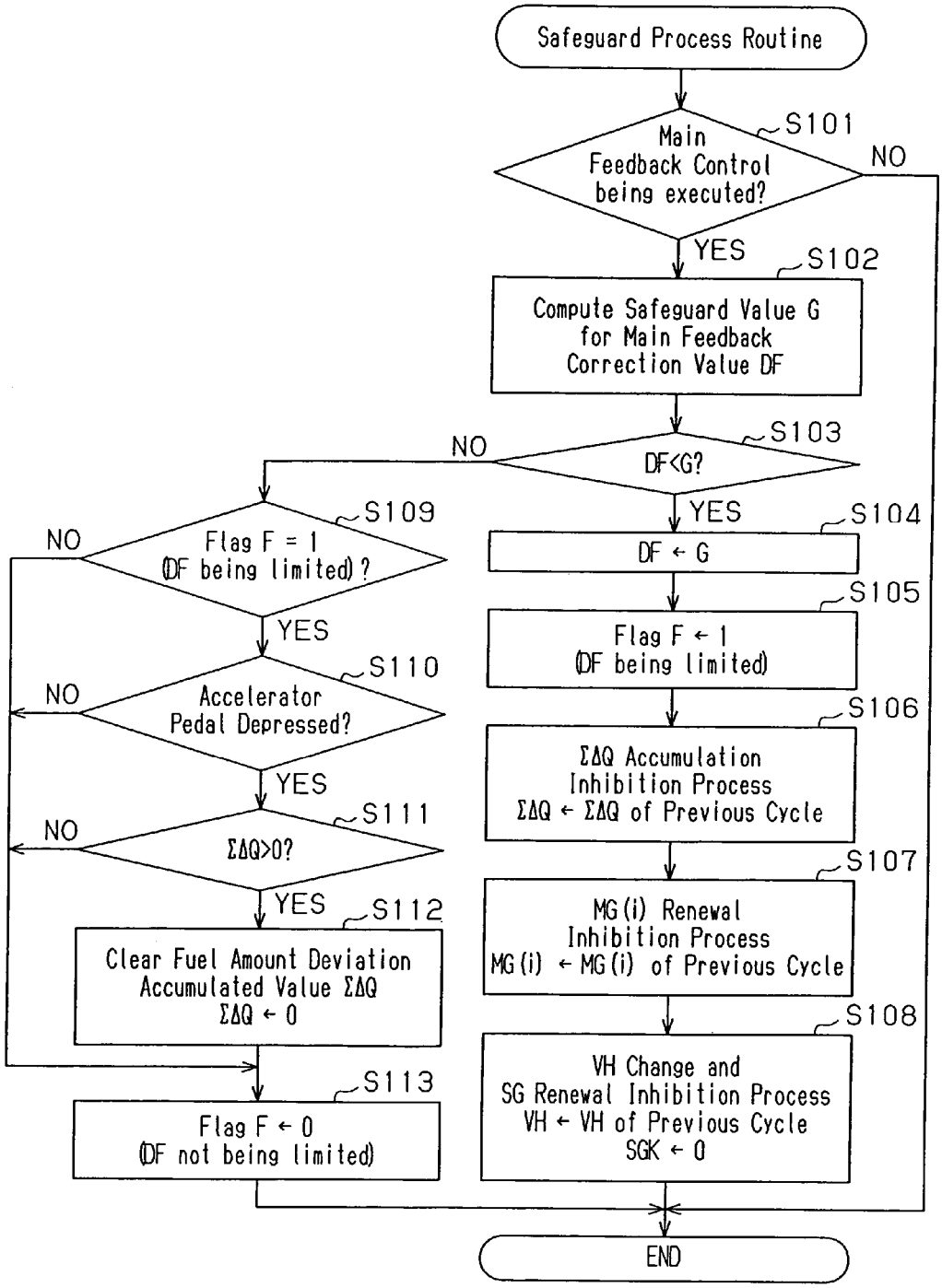
FIG. 6 is a flowchart showing a lower limit safeguard process for the main feedback correction value DF.

The safeguard process will now be described with reference to the flowchart of a safeguard process routine shown in FIG. 6. The safeguard process routine is executed as an interrupt by the electronic control unit 8, for example, at predetermined time intervals.

In the routine, if the main feedback control is being executed (S101: YES), the safeguard value G used for safeguarding the main feedback correction value DF from falling below the lower limit is computed (S102). The safeguard value G is equal to the main feedback correction value DF that causes the instructed injection time tau to be equal to the permissible minimum time TAUMIN. The main feedback correction value DF, which corresponds to the permissible minimum time TAUMIN, is computed using the following expression (14).

$$DF=\{(TAUMIN-KINJB)/(K1\cdot KINJA)\}-Qbase-MG(i) \quad (14)$$

DE: main feedback correction value
TAUMIN: permissible Minimum Time
K1: fuel pressure correction coefficient
KINJA: sensitivity coefficient
KINJB: invalid injection time
Qbase: basic fuel injection amount
MG(i): main feedback learning value Expression (14) is obtained by substituting the permissible minimum time TAUMIN for the instructed injection time tau of expression (1), and substituting the right side of expression (2) for the instructed injection amount Q and transforming it. By changing the left side of expression (14) to the safeguard value G, expression (14) is changed to expression (15) ($G=\{(TAUMIN-KINJB)/(K1\cdot KINJA)\}-Qbase-MG(i)$) for computing the safeguard value G.

After computing the safeguard value G, whether the instructed injection time tau is less than the permissible minimum time TAUMIN is determined (S103) based on whether the current main feedback correction value DE is less than the safeguard value G.

If the decision outcome is positive, the instructed injection time tau is determined to be less than the permissible minimum time TAUMIN. In this case, the safeguard value G is set as a new value of the main feedback correction value DE (S104). This process safeguards the main feedback correction value DE from falling below the safeguard value G, so that the instructed injection time tau does not become shorter than the permissible minimum time TAUMIN. In the subsequent step S105, flag F, which indicates whether the lower limit safeguard process is being executed for the main feedback correction value DF, set to 1 (safeguard process being executed). Thereafter, various types of processes (S106 to S108) for the lower limit safeguard process are executed in the manner described below.

[1] A $\Sigma\Delta Q$ accumulation inhibition process (S106) for inhibiting accumulation of the fuel amount deviation accumulated value $\Sigma\Delta Q$ used in expression (4).

[2] An MG(i) renewal inhibition process (107) for inhibiting renewal of the main feedback learning value MG(i) based on expression (8).

[3] A VH change and SG renewal inhibition process (S108) for inhibiting increase and decrease in the sub-feedback correction value VH based on expression (10) and renewal of the sub-feedback learning value SG based on expression (13).

When main feedback correction value DF is limited to the safeguard value G, if the main feedback correction value DF reaches or surpasses the guard value G, the limit to the correction value DF is cancelled. At this time, based on the fact that the main feedback correction value DF is greater than or equal to the safeguard value G, the instructed injection time tau is determined to be greater than or equal to the permissible minimum time TAUMIN (S103: NO). The process then advances to step S109. At step S109, whether flag F is 1 (safeguard process is being executed) is determined. Since flag F is set to 1 (safeguard process is being executed) immediately after the main feedback correction value DF reaches or surpasses the safeguard value G, the decision outcome of step S109 is positive. On the condition that the lower limit safeguard process has just been cancelled, process [4] is executed.

[4] A ΣΔQ clearing process for clearing the fuel amount deviation accumulated value ΣΔQ, which is used for computing the main feedback correction value DF, to 0 (S110~S112).

After executing the ΣΔQ clearing process, flag F is set to 0 (safeguard process is not being executed) at S113. Thereafter, the decision outcome at step S109 is negative and the ΣΔQ clearing process is skipped. Thus, the ΣΔQ clearing process is executed once every time the lower limit safeguard process is cancelled.

Each of the processes [1] to [4] will now be described.

[1] ΣΔQ Accumulation Inhibition Process (S106)

The ΣΔQ accumulation inhibition process is executed during the lower limit safeguard process for the main feedback correction value DF. In FIG. 7, section (b) shows changes in the main feedback correction value DF during the lower limit safeguard process, and section (a) shows changes in the instructed injection time tau during the lower limit safeguard process. During the lower limit safeguard process, since decrease of the instructed injection time tau is limited such that the instructed injection time tau does not become shorter than the permissible minimum time TAUMIN, the actual air-fuel ratio ABF inevitably becomes richer than the stoichiometric air-fuel ratio.

Therefore, when the main feedback correction value DF is limited to the safeguard value G, the fuel amount deviation ΔQ, based on the actual air-fuel ratio ABF, keeps having a value that decreases the instructed injection amount Q as shown in FIG. 7 (*c*), that is, a value greater than 0. Under such circumstances, if the accumulation process of the fuel amount deviation accumulated value ΣΔQ, that is, expression (7) (ΣΔQ←ΣΔQ of the previous cycle+ΔQ) is calculated at a predetermined time interval when the correction value DF is limited, the fuel amount deviation accumulated value ΣΔQ changes along broken line shown in section (d) of FIG. 7. More specifically, the fuel amount deviation accumulated value ΣΔQ is increased, or is changed in a direction decreasing the main feedback correction value DF (instructed injection amount Q). In this case, when the limit to the main feedback correction value DF is canceled, the instructed injection amount Q is corrected by the amount corresponding to the integral term ΣΔQ·Gi in expression (4) by the correction value DF. The fuel injection amount is significantly decreased, accordingly. This could lead to a misfire due to lean air-fuel mixture.

To avoid such problems, the ΣΔQ accumulation inhibition process is executed when the main feedback correction value DF is limited to the safeguard value G. Specifically, instead of calculating expression (7) at a predetermined time interval, expression (16) (ΣΔQ←ΣΔQ of the previous cycle) is calculated to maintain the fuel amount deviation accumulated value ΣΔQ to the value of the previous cycle, thereby inhibiting the accumulation process of the fuel amount deviation accumulated value ΣΔQ. As a result, the fuel amount deviation accumulated value ΣΔQ is maintained to a constant value as shown by solid line in section (d) of FIG. 7. This prevents, when the correction value DF is limited, the fuel amount deviation accumulated value ΣΔQ (integral term ΣΔQ·Gi) from being changed in the direction decreasing the instructed injection amount Q. Therefore, when the limit to the correction value DF is cancelled, even if the instructed injection amount Q is corrected by the amount corresponding to the integral term ΣΔQ·Gi, a misfire due to lean air-fuel mixture is prevented.

The accumulation of the fuel amount deviation accumulated value ΣΔQ may be inhibited by a method other than maintaining the fuel amount deviation accumulated value ΣΔQ to the value of the previous cycle. Specifically, the fuel amount deviation accumulated value ΣΔQ may be cleared to 0 as shown by chain double-dashed line in section (d) of FIG. 7.

However, immediately before the correction value DF starts being limited, the fuel amount deviation accumulated value ΣΔQ has a value that decreases the main feedback correction value DF (the instructed injection amount Q). Thus, if the fuel amount deviation accumulated value ΣΔQ is cleared and maintained to 0, the instructed injection amount Q is not decreased by the amount corresponding to the integral term ΣΔQ·Gi. This increases the fuel injection amount. As a result, the main feedback correction value DF becomes greater than or equal to the safeguard value G, and the limit to the correction value DF is cancelled. However, even if the limit to the correction value DF is canceled in this manner, the correction value DF becomes less than the safeguard value G (the instructed injection time tau becomes less than the permissible minimum time TAUMIN) according to changes in the main feedback correction value DF based on the proportional term ΔQ-Gp, and the main feedback correction value DF is safeguarded from falling below the safeguard value G.

As described above, if the fuel amount deviation accumulated value ΣΔQ is cleared and maintained to 0 when the correction value DF is limited, the main feedback correction value DF and the instructed injection time tau change as shown by broken lines of sections (b) and (a) of FIG. 7. This causes hunting where the limit to the correction value DF is repeatedly started and cancelled. However, since the accumulation process of the fuel amount deviation accumulated value ΣΔQ is inhibited by maintaining the value of the previous cycle of the fuel amount deviation accumulated value ΣΔQ, such hunting is prevented.

[2] MG(i) Renewal Inhibition Process (S107)

The MG(i) renewal inhibition process is also executed when the main feedback correction value DF is limited. When the correction value DF is limited, the main feedback correction value DF is prevented from falling below the safeguard value G, so that the instructed injection time tau does not become shorter than the permissible minimum time TAUMIN. If the main feedback learning value MG(i) is renewed using expression (8) (MG(i)←the newest DF) based on the main feedback correction value DF after being limited to the safeguard value G, the learning value MG(i) will be renewed to an inappropriate value. Section (e) of FIG. 7 shows an example of changes in the main feedback learning value MG(i) in such a situation.

To avoid a problem of renewal of the main feedback learning value MG(i) to an inappropriate value, the MG(i) renewal inhibition process is executed when the correction value DF is limited. Specifically, instead of renewing the main feedback learning value MG(i) using expression (8), expression (17) (MG(i)←MG(i) of the previous cycle) is calculated to maintain the main feedback learning value MG(i) to the value of the previous cycle, thereby inhibiting the renewal of the learning value MG(i). This prevents the main feedback learning value MG(i) from being renewed to an inappropriate value.

[3] VH Change and SG Renewal Inhibition Process (S108)

The VH change and SG renewal inhibition process is also executed when the main feedback correction value DF is limited. Since the rich combustion is performed when the correction value DF is limited, the oxygen concentration of exhaust in the section downstream of the catalysts is less than the value X of the oxygen concentration when the air-fuel mixture is burned at the stoichiometric air-fuel ratio. Accordingly, the output VO of the oxygen sensor 15 becomes greater than the 0.5v. Thus, the voltage deviation ΔV of expression (10) is increased, and the sub-feedback correction value VH is decreased. As a result, the main feedback correction value DF (output VAF of the air-fuel ratio sensor 14) tends to be decreased.

However, since the main feedback correction value DF is limited to the safeguard value G, the oxygen concentration of exhaust in the section downstream of the catalysts cannot approach the value X, and only the sub-feedback correction value VH is gradually decreased as shown by broken line in section (f) of FIG. 7. This could cause the correction value VH to diverge. If the sub-feedback correction value VH diverges, the sub-feedback learning value SG, which is renewed based on the correction value VH, could be renewed to an inappropriate value. As a result, the sub-feedback learning value SG is gradually decreased as shown by broken line in section (g) of FIG. 7, in correspondence with the diverging sub-feedback correction value VH.

To avoid such problems, the VH change and SG renewal inhibition process is executed when the correction value DF is limited. More specifically, instead of computing the sub-feedback correction value VH based on expression (10), the sub-feedback correction value VH is maintained to the value of the previous cycle by executing expression (18) (VH←VH of the previous cycle). Alternatively, the correction value VH is cleared and maintained to 0, so that changes in the correction value VH are inhibited. As a result, the sub-feedback correction value VH is maintained to a constant value as shown by a solid line in section (f) of FIG. 7. Further, when renewing the sub-feedback learning value SG using expression (13) (SG←SG of the previous cycle+SGK), expression (19) (SGR←0) is executed to set the renewal value SGK to 0, so that the renewal of the sub-feedback learning value SG is inhibited. As a result, the sub-feedback learning value SG is maintained to a constant value as shown by a solid line in section (g) of FIG. 7.

As described above, the sub-feedback correction value VH and the sub-feedback learning value SG are maintained to constant values to prevent the sub-feedback correction value VH from diverging, and the sub-feedback learning value SG from being renewed to an inappropriate value.

[4] ΣΔQ Clearing Process (S110 to S112)

The ΣΔQ clearing process is executed immediately after the limit to the main feedback correction value DF is cancelled.

Figures 8A, 8B, 8C:
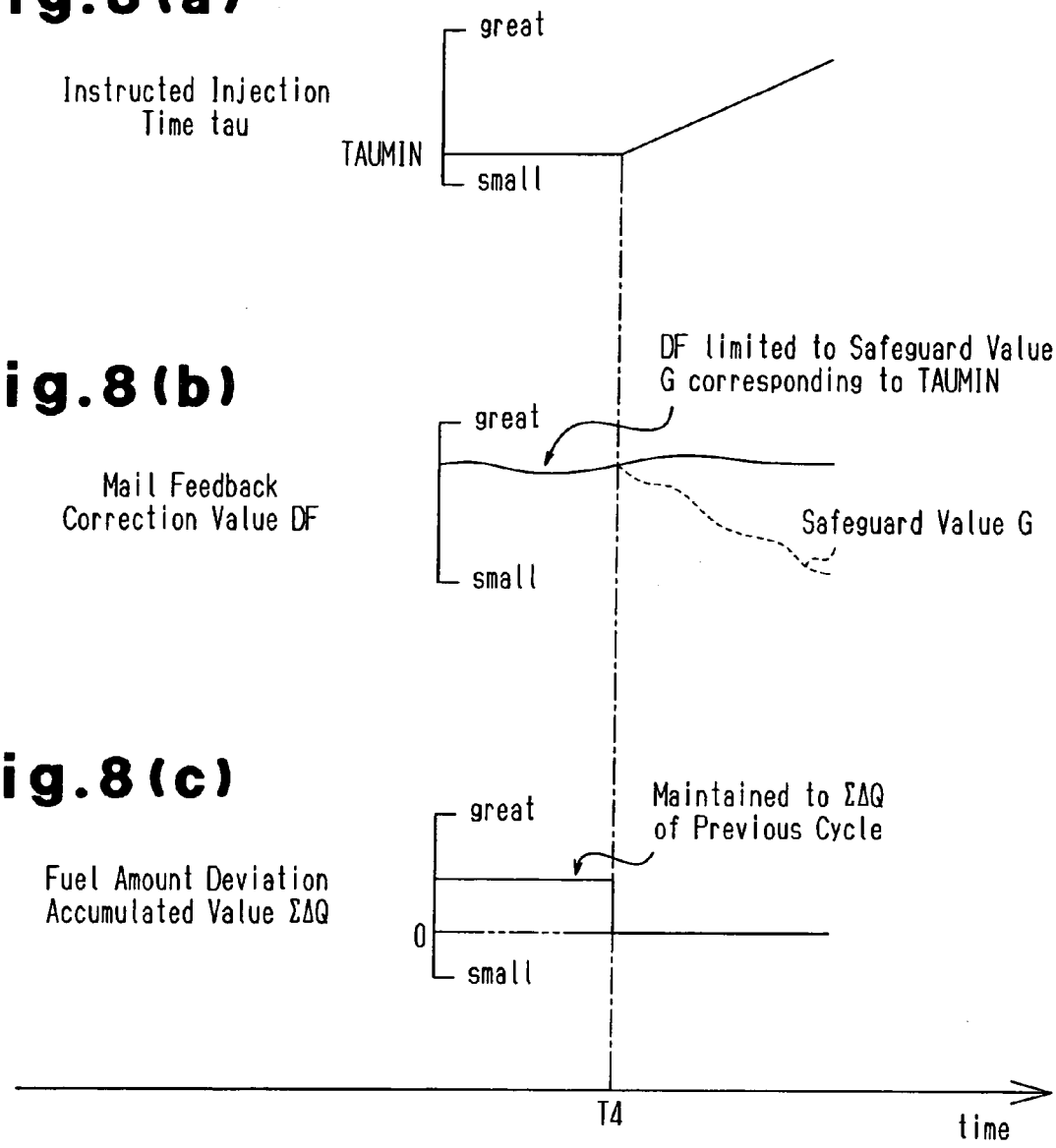
FIG. 8 is a time chart showing the state when the lower limit safeguard process for the main feedback correction value DF is cancelled, in which section (a) shows changes in the instructed injection time tau, section (b) shows changes in the main feedback correction value DF, and section (c) shows changes in the fuel amount deviation accumulated value $\Sigma\Delta Q$.

The period prior to time T4 in the time chart of FIG. 8 corresponds to a state where the correction value DF is limited. When the correction value DF is limited, if the accelerator pedal 9 is depressed for, for example, acceleration, the throttle valve 3 is opened accordingly so that the intake air amount of the engine 1 is increased. This increases the instructed injection amount Q (the base fuel injection amount Qbase). As a result, the safeguard value G computed based on expression (15) is significantly less than the main feedback correction value DF as shown by broken line after time T4 in section (b) of FIG. 8. This means that the instructed injection time tau is extended to be significantly longer than the permissible minimum time TAUMIN as shown by solid line after time T4 in section (a) of FIG. 8. When the safeguard value G becomes less than the main feedback correction value DF, and the instructed injection time tau becomes longer than the permissible minimum time TAUMIN as described above, the limit to the correction value DF is cancelled.

When the instructed injection time tau becomes longer than or equal to the permissible minimum time TAUMIN as the intake air amount is increased, and the limit to the correction value DF is cancelled, the integral term ΣΔQ·Gi of the main feedback correction value DF (fuel amount deviation accumulated value ΣΔQ) at the time is under the condition of a sudden increase of the intake air amount. The integral term ΣΔQ·Gi is unreliable in this state. In such a case, through the ΣΔQ clearing process, on the condition that the fuel amount deviation accumulated value ΣΔQ has a value decreasing the main feedback correction value DF, or a value decreasing the instructed injection amount Q, the fuel amount deviation accumulated value ΣΔQ is set to 0 as shown in section (c) of FIG. 8. Accordingly, the integral term ΣΔQ·Gi is cleared to 0.

More specifically, at step S110 of the safeguard process routine (FIG. 6), whether the limit to the correction value DF has been cancelled due to increase of the intake air amount is determined based on whether the accelerator pedal 9 is being depressed. At step S111, based on whether the fuel amount deviation accumulated value ΣΔQ has a positive value, whether the fuel amount deviation accumulated value ΣΔQ has a value decreasing the main feedback correction value DF is determined. If the decision outcomes of step S110 and step S111 are both positive, it is determined that the limit to the correction value DF has been cancelled due to increase of the intake air amount, and the fuel amount deviation accumulated value ΣΔQ has a value decreasing the main feedback correction value DF. Then, at step S112, the fuel amount deviation accumulated value ΣΔQ is set to 0.

Accordingly, the integral term ΣΔQ·Gi is cleared to 0. If the integral term ΣΔQ·Gi (fuel amount deviation accumulated value ΣΔQ) has a value decreasing the main feedback correction value DF, the operation of the engine 1 in an operation region that requires a small amount of fuel injection tends to cause a misfire due to lean air-fuel mixture. Particularly, in the case where the engine 1 is provided with a blowby gas returning device, since in such an operation region the ratio of fuel component derived from blowby gas to the fuel supplied to the combustion chamber 4 is relatively high, the fuel amount deviation accumulated value ΣΔQ is likely to have a value that significantly decreases the main feedback correction value DF. This is likely to cause a misfire due to lean air-fuel mixture. However, since the integral term ΣΔQ·Gi is cleared to 0 when the reliability of the integral term ΣΔQ·Gi is lowered, misfire due to lean air-fuel mixture is prevented in the above mentioned operation region.

When the integral term ΣΔQ·Gi is cleared, the intake air amount is increased, and the base fuel injection amount Qbase has a great value. Also, the main feedback correction value DF is greatly different from the safeguard value G. Thus, even if the integral term ΣΔQ·Gi is cleared, and the fuel injection amount is not corrected by the amount corresponding to the integral term ΣΔQ·Gi, the magnitude correlation between the main feedback correction value DF and the safeguard value G is not repeatedly reversed. As a result, hunting where the limit to the correction value DF is repeatedly started and cancelled is prevented.

The above described embodiment has the following advantages.

(1) While the main feedback control is executed, the safeguard value G is computed as a safeguard value used in the lower limit safeguard process for the main feedback correction value DF. The safeguard value G corresponds to a value of the main feedback correction value DF that causes the instructed injection time tau to be equal to the permissible minimum time TAUMIN. When the main feedback correction value DF falls below the safeguard value G, and it is determined that the instructed injection time tau is shorter than the permissible minimum time TAUMIN, the lower limit safeguard process is executed, in which the main feedback correction value DF is set to the safeguard value G. Through the lower limit safeguard process, the instructed injection time tau is prevented from becoming shorter than the permissible minimum time TAUMIN.

In a case where the main feedback correction value DF stays significantly less than the reference value (0), if the main feedback correction value DF becomes greater than or equal to the safeguard value G immediately after the correction value DF starts being limited, it could be determined that the instructed injection time tau has become longer than or equal to the permissible minimum time TAUMIN, and the limit to the correction value DF could be cancelled. In this case, a value of the main feedback correction value DF that causes the actual air-fuel ratio ABF to be equal to the stoichiometric air-fuel ratio after the limit to the correction value DF is cancelled is significantly less than a value immediately before the correction value DF starts being limited, that is, significantly less than the reference value (0).

Therefore, if the main feedback correction value DF is set to the reference value (0) when the limit to the correction value DF is cancelled as in the BACKGROUND OF THE INVENTION section, the starting point of changes in the correction value DF based on the actual air-fuel ratio ABF is the reference value (0). When the correction value DF starts changing, the actual air-fuel ratio ABF is richer than the stoichiometric air-fuel ratio. Also, after the limit to the correction value DF is cancelled, changes in the main feedback correction value DF based on the actual air-fuel ratio ABF cause the actual air-fuel ratio ABF to approach the stoichiometric air-fuel ratio. Since the changes in the main feedback correction value DF starts from the reference value (0), it takes a relatively long time for the actual air-fuel ratio ABF to reach to the stoichiometric air-fuel ratio. Until the period elapses, the actual air-fuel ratio ABF stays richer than the stoichiometric air-fuel ratio.

However, if the lower limit safeguard process for the main feedback correction value DF is executed using the safeguard value G corresponding to the permissible minimum time TAUMIN as described above, changes in the main feedback correction value DF based on the actual air-fuel ratio ABF are started from the safeguard value G as the starting point after the lower limit safeguard process is cancelled. Therefore, immediately after the lower limit safeguard process is cancelled, the instructed injection amount Q is corrected based on the main feedback correction value DF, thereby preventing the actual air-fuel ratio ABF from being excessively rich. Further, since the safeguard value G is used as the starting point of changes in the main feedback correction value DF for causing the actual air-fuel ratio ABF to be stoichiometric air-fuel ratio immediately after the lower limit safeguard process is cancelled, the actual air-fuel ratio ABF quickly converges to the stoichiometric air-fuel ratio through the changes in the main feedback correction value DF, while preventing the actual air-fuel ratio ABF from being rich.

As described above, under the condition in which the main feedback correction value DF stays significantly less than the reference value (0), if the limit to the correction value DF is cancelled immediately after the correction value DF starts being limited, the actual air-fuel ratio ABF is prevented from being rich. This prevents the emission and the combustion state from being adversely affected.

(2) When the main feedback correction value DF is limited, the fuel amount deviation $\Delta Q$ keeps having a value that increases the instructed injection amount Q, that is, a value greater than 0. When the accumulation process of the fuel amount deviation accumulated value $\Sigma\Delta Q$ is executed under this condition, the fuel amount deviation accumulated value $\Sigma\Delta Q$ is increased, or changed in a direction decreasing the main feedback correction value DF (instructed injection amount Q). In this case, when the limit to the main feedback correction value DF is canceled, the instructed injection amount Q is corrected by the amount corresponding to the integral term $\Sigma\Delta Q \cdot Gi$ in expression (4) by the correction value DF. The fuel injection amount is significantly decreased, accordingly. This could lead to a misfire due to lean air-fuel mixture.

However, when the correction value DF is limited, the $\Sigma\Delta Q$ accumulation inhibition process is executed in which the accumulation process of the fuel amount deviation accumulated value $\Sigma\Delta Q$ as in the process [1] is inhibited. Specifically, the fuel amount deviation accumulated value $\Sigma\Delta Q$ is maintained to the value of the previous cycle. This prevents, when the correction value DF is limited, the fuel amount deviation accumulated value $\Sigma\Delta Q$ (integral term $\Sigma\Delta Q \cdot Gi$) from being changed in the direction decreasing the instructed injection amount Q. Therefore, when the limit to the correction value DF is cancelled, even if the instructed injection amount Q is corrected by the amount corresponding to the integral term $\Sigma\Delta Q \cdot Gi$, a misfire due to lean air-fuel mixture is prevented.

As a $\Sigma\Delta Q$ accumulation inhibition process, a procedure may be used in which the fuel amount deviation accumulated value $\Sigma\Delta Q$ is cleared to 0. However, in this case, hunting occurs that the limit to the correction value DF is repeatedly started and cancelled as described above. In this respect, if the $\Sigma\Delta Q$ accumulation inhibition process in which the fuel amount deviation accumulated value $\Sigma\Delta Q$ is maintained to the value of the previous cycle is executed, the hunting of repetitive starting and canceling of the limit to the correction value DF is prevented.

(3) When the main feedback correction value DF is prevented from falling below the safeguard value G, if the main feedback learning value MG(i) is renewed based on the safeguarded main feedback correction value DF, the learning value MG(i) is renewed to an inappropriate value. However, when the correction value DF is limited to the safeguard value G, the MG(i) renewal inhibition process is executed in which the renewal of the main feedback learning value MG(i) as in the process [2] is inhibited. Specifically, the learning value MG(i) is maintained to the value of the previous cycle. This prevents the main feedback learning value MG(i) from being renewed to an inappropriate value.

(4) Since the rich combustion is performed when the correction value DF is limited, the oxygen concentration of exhaust in the section downstream of the catalysts is less than the value X of the oxygen concentration in the combustion of air-fuel mixture at the stoichiometric air-fuel ratio. Accordingly, the sub-feedback correction value VH is decreased so that the main feedback correction value DF (the output VAF of the air-fuel ratio sensor 14) tends to be decreased. However, since the main feedback correction value DF is subjected to the lower limit safeguard process, the oxygen concentration of exhaust in the section downstream of the catalysts cannot approach the value X, and only the sub-feedback correction value VH is gradually decreased. This could cause the correction value VH to diverge. If the sub-feedback correction value VH diverges, the sub-feedback learning value SG, which is renewed based on the correction value VH, could be renewed to an inappropriate value.

Such divergence of the sub-feedback correction value VH and renewal of the sub-feedback learning value SG to an appropriate value are avoided by executing VH change and SG renewal inhibition process, or the process [3], when the correction value DF is limited. That is, as the VH change and SG renewal inhibition process, a process for inhibiting changes in the sub-feedback correction value VH and a process for setting the renewal amount SGK of the sub-feedback learning value SG to 0, thereby inhibiting the renewal of the learning value SG, are executed. Accordingly, divergence of the correction value VH and renewal of the learning value SG to an inappropriate value are prevented.

(5) When the main feedback correction value DF is limited, if the instructed injection amount Q (the base fuel injection amount Qbase) is increased as the intake air amount is increased, the safeguard value G becomes significantly less than the main feedback correction value DF. This means that the instructed injection time tau becomes significantly longer than the permissible minimum time TAUMIN. When the safeguard value G becomes less than the main feedback correction value DF, and the instructed injection time tau becomes longer than the permissible minimum time TAUMIN as described above, the limit to the correction value DF is cancelled.

When the instructed injection time tau becomes longer than or equal to the permissible minimum time TAUMIN as the intake air amount is increased, and the limit to the correction value DF is cancelled, the integral term $\Sigma\Delta Q \cdot Gi$ of the main feedback correction value DF (fuel amount deviation accumulated value $\Sigma\Delta Q$) at the time is under the condition of a sudden increase of the intake air amount. The integral term $\Sigma\Delta Q \cdot Gi$ is unreliable in this state. In such a case, through the $\Sigma\Delta Q$ clearing process, on the condition that the fuel amount deviation accumulated value $\Sigma\Delta Q$ has a value decreasing the main feedback correction value DF, or a value decreasing the instructed injection amount Q, the fuel amount deviation accumulated value $\Sigma\Delta Q$ is set to 0. Accordingly, the integral term $\Sigma\Delta Q \cdot Gi$, which is used for computing the main feedback correction value DF, is cleared to 0.

If the integral term $\Sigma\Delta Q \cdot Gi$ (fuel amount deviation accumulated value $\Sigma\Delta Q$) has a value decreasing the main feedback correction value DF, the operation of the engine 1 in an operation region that requires a small amount of fuel injection tends to cause a misfire due to lean air-fuel mixture. However, since the integral term $\Sigma\Delta Q \cdot Gi$ is cleared to 0 through the $\Sigma\Delta Q$ clearing process when the reliability of the integral term $\Sigma\Delta Q \cdot Gi$ is lowered, misfire due to lean air-fuel mixture is prevented in the above mentioned operation region.

When the integral term $\Sigma\Delta Q \cdot Gi$ is cleared, the intake air amount is increased, and the base fuel injection amount Qbase has a great value. Also, the main feedback correction value DF is greatly different from the safeguard value G. Thus, even if the integral term $\Sigma\Delta Q \cdot Gi$ is cleared, and the fuel injection amount is not corrected by the amount corresponding to the integral term $\Sigma\Delta Q \cdot Gi$, the magnitude correlation between the main feedback correction value DF and the safeguard value G is not repeatedly reversed. As a result, hunting where the limit to the correction value DF is repeatedly started and cancelled is prevented.

(6) Whether the limit to the main feedback correction value DF has been cancelled due to an increase of the intake air amount is determined based on whether the accelerator pedal 9 is depressed when the limit to the correction value DF is cancelled. When the accelerator pedal 9 is being depressed, the throttle valve 3 is open and the intake air amount to the engine 1 is increased. Therefore, based on the fact that the accelerator pedal 9 is depressed when the limit to the correction value DF is cancelled, it is reliably determined that the cancellation of the limit to the correction value DF is due to an increase of the intake air amount.

The above described embodiment may be modified as follows.

In the VH change and SG renewal inhibition process, or the process [3], at step S108 (FIG. 6) of the safeguard process routine, it is not necessary to execute both of the inhibition of changes in the sub-feedback correction value VH and the inhibition of the renewal of the sub-feedback learning value SG, but only one of them may be executed.

In the $\Sigma\Delta Q$ clearing process, or process [4], at steps S110 to S112 (FIG. 6) of the safeguard process routine, it is determined whether the limit to the main feedback correction value DF has been cancelled due to an increase of the intake air amount based on whether the accelerator pedal 9 is depressed (S110). However, the present invention is not limited to this configuration. The determination may be performed based on an increase of the engine load ratio, for example, based on whether an increase of the engine load ratio is equal to or greater than a predetermined value greater than 0. In this case, by adjusting the predetermined value to an optimum value (for example, 2%), the determination is performed accurately.

Whether the limit to the main feedback correction value DF has been cancelled due to an increase of the intake air amount may be determined based on whether the learning region i of the main feedback learning value MG(i) has been switched during a period from when the limit to the correction value DF is started to when the limit to the correction value DF is cancelled. In this case, based on the fact that the learning region i has been switched, it is determined that the limit to the main feedback correction value DF has been cancelled due to an increase of the intake air amount. When the intake air amount is changed by such a degree that the learning region i is changed, the reliability of the integral term $\Sigma\Delta Q \cdot Gi$ at the time of canceling the limit to the correction value DF is extremely low. In this case, through the $\Sigma\Delta Q$ clearing process, the fuel amount deviation accumulated value $\Sigma\Delta Q$ (integral term $\Sigma\Delta Q \cdot Gi$) can be cleared to 0.

In the $\Sigma\Delta Q$ clearing process, the fuel amount deviation accumulated value $\Sigma\Delta Q$ (integral term $\Sigma\Delta Q \cdot Gi$) is cleared on the condition that the fuel amount deviation accumulated value $\Sigma\Delta Q$ has a value that decreases the feedback correction value DF ($\Sigma\Delta Q>0$). However, the fuel amount deviation accumulated value $\Sigma\Delta Q$ may be cleared on the condition that expression $\Sigma\Delta Q \leqq 0$ is satisfied. In this case, step S111 of the safeguard process routine is omitted.

In the $\Sigma\Delta Q$ accumulation inhibition process, or process [1], at step S106 (FIG. 6) of the safeguard process routine, the fuel amount deviation accumulated value $\Sigma\Delta Q$ is maintained to the value of the previous cycle. However, the fuel amount deviation accumulated value $\Sigma\Delta Q$ may be cleared to 0. In this case also, a misfire due to lean air-fuel mixture is prevented.

Processes [1] to [4] do not need to be executed. Only one or a few of the processes may be executed as necessary.

The main feedback learning control does not need to be executed.

The sub-feedback control and the sub-feedback learning control do not need to be executed. For example, these control processes may be omitted. Alternatively, only the sub-feedback control may be executed.

The invention claimed is:

1. An apparatus for controlling fuel injection of an internal combustion engine that has a fuel injection valve, comprising:

a feedback correction value that is changed based on an actual air-fuel ratio to conform the actual air-fuel ratio to a target air-fuel ratio of the engine;

a limit value of the feedback correction value;

a fuel injection time controlling the fuel injection valve, the fuel injection time being set based on the target air-fuel ratio and the feedback correction value;

a permissible minimum time of the fuel injection time, wherein, when a value of the fuel injection time is determined to be less than the permissible minimum time based on the target air-fuel ratio, the apparatus limits a lowest value of the feedback correction value to the limit value, the feedback correction value includes a proportional term and an integral term, the proportional term being computed based on a difference between an actual fuel injection amount and a theoretical fuel injection amount that is required for an actual air-fuel ratio to be equal to the target air-fuel ratio, the integral term being computed based on a process for accumulating the difference at predetermined intervals, and wherein the apparatus initializes the integral term when the apparatus has canceled limiting the feedback correction value as an intake air amount of the engine increases, when limiting the feedback correction value is canceled as the intake air amount of the engine increases, the apparatus initializes the integral term based on a condition that the integral term has a value that decreases the feedback correction value.

2. The apparatus according to claim 1, wherein the apparatus renews a learning value based on the feedback correction value, the learning value being used to compensate for a constant deviation of the actual air-fuel ratio from a stoichiometric air-fuel ratio, and further corrects a fuel injection amount using the learning value, and wherein the apparatus inhibits renewal of the learning value when the feedback correction value is limited to the limit value.

3. The apparatus according to claim 2, wherein the apparatus inhibits renewal of the learning value by maintaining the learning value to a value that corresponds to the feedback correction value when limited to the limit value.

4. The apparatus according to claim 1, wherein the feedback correction value includes a proportional term and an integral term, the proportional term being computed based on a difference between an actual fuel injection amount and a theoretical fuel injection amount that is required for an actual air-fuel ratio to be equal to the target air-fuel ratio, the integral term being computed based on a process for accumulating the difference into an accumulated value at predetermined intervals, and wherein the apparatus inhibits the process for accumulating the difference when the feedback correction value is limited to the limit value.

5. The apparatus according to claim 4, wherein the apparatus inhibits the process for accumulating the difference by maintaining the accumulated value to a value that corresponds to the feedback correction value when limited to the limit value.

6. The apparatus according to claim 1, wherein the apparatus is mounted on a vehicle having an accelerator pedal, and wherein the apparatus determines that the intake air amount of the engine increases when a manipulation amount of the accelerator pedal increases.

7. The apparatus according to claim 1, wherein the apparatus determines that the intake air amount of the engine increases when a load ratio of the engine increases.

8. The apparatus according to claim 1, wherein the apparatus renews a learning value based on the feedback correction value, the learning value being used to compensate for a constant deviation of the actual air-fuel ratio from a stoichiometric air-fuel ratio in each of a plurality of learning regions divided according to load regions of the engine, and further the fuel injection amount is corrected using the learning value, and wherein the apparatus determines that the intake air amount of the engine increases when the learning region is different between when limiting the feedback correction value is started and when the limiting is canceled.

9. The apparatus according to claim 1, wherein the engine has an exhaust purification catalyst, the feedback correction value being a main feedback correction value that is changed according to a concentration of oxygen of exhaust in a section upstream of the catalyst, wherein the apparatus changes a sub-feedback correction value to cause a concentration of oxygen of exhaust in a section downstream of the catalyst to be equal to a target concentration, and renews, based on a sub-feedback correction value, a sub-feedback learning value used for compensating for a constant deviation of the actual air-fuel ratio from a stoichiometric air-fuel ratio, wherein the apparatus corrects the main feedback correction value using the sub-feedback correction value and the sub-feedback learning value, and wherein the apparatus inhibits changes in the sub-feedback correction value when the feedback correction value is limited to the limit value.

10. The apparatus according to claim 9, wherein the apparatus inhibits changes in the sub-feedback correction value by maintaining the sub-feedback correction value to a value corresponding to the feedback correction value when limited to the limit value.

11. The apparatus according to claim 1, wherein the engine has an exhaust purification catalyst, the feedback correction value being a main feedback correction value that is changed according to a concentration of oxygen of exhaust in a section upstream of the catalyst, wherein the apparatus changes a sub-feedback correction value to cause a concentration of oxygen of exhaust in a section downstream of the catalyst to be equal to a target concentration, and renews, based on a sub-feedback correction value, a sub-feedback learning value used for compensating for a constant deviation of the actual air-fuel ratio from a stoichiometric air-fuel ratio, wherein the apparatus corrects the main feedback correction value using the sub-feedback correction value and the sub-feedback learning value, and wherein the apparatus inhibits renewal of the sub-feedback learning value when the feedback correction value is limited to the limit value.

12. The apparatus according to claim 11, wherein the apparatus inhibits renewal of the sub-feedback learning value by setting a renewal value of the sub-feedback learning value to 0.

13. An internal combustion engine comprising:

a combustion chamber in which air-fuel mixture is burned;

a fuel injection valve that injects fuel into the combustion chamber; and a controller that corrects a fuel injection amount of the fuel injection valve using a feedback correction value to cause an actual air-fuel ratio of an air-fuel mixture burned in the combustion chamber to be equal to a target value, the feedback correction value being changed based on the actual air-fuel ratio, wherein the controller computes a limit value, the limit value being a value of the feedback correction value that causes a fuel injection time of the fuel injection valve to be a permissible minimum time, and wherein, when a value of the fuel injection time is determined to be less than the permissible minimum time based on the target value, the controller limits a lowest value of the feedback correction value to the limit value, the feedback correction value includes a proportional term and an integral term, the proportional term being computed based on a difference between an actual fuel injection amount and a theoretical fuel injection amount that is required for an actual air-fuel ratio to be equal to the target value, the integral term being computed based on a process for accumulating the difference at predetermined intervals, and wherein the controller inhibits the process for accumulating the difference when the feedback correction value is limited to the limit value, when limiting the feedback correction value is canceled, the integral term is initialized based on a condition that the integral term has a value that decreases the feedback correction value.

14. The internal combustion engine according to claim 13, wherein the controller renews a learning value based on the feedback correction value, the learning value being used to compensate for a constant deviation of the actual air-fuel ratio from a stoichiometric air-fuel ratio, and further corrects the fuel injection amount using the learning value, and wherein the controller inhibits renewal of the learning value when the feedback correction value is limited to the limit value.

15. The internal combustion engine according to claim 13, wherein the engine has an exhaust purification catalyst, the feedback correction value being a main feedback correction value that is changed according to a concentration of oxygen of exhaust in a section upstream of the catalyst, wherein the controller changes a sub-feedback correction value to cause a concentration of oxygen of exhaust in a section downstream of the catalyst to be equal to a target concentration, and renews, based on a sub-feedback correction value, a sub-feedback learning value used for compensating for a constant deviation of the actual air-fuel ratio from a stoichiometric air-fuel ratio, wherein the controller corrects the main feedback correction value using the sub-feedback correction value and the sub-feedback learning value, and wherein the controller inhibits changes in the sub-feedback correction value when the feedback correction value is limited to the limit value.

16. The internal combustion engine according to claim 13, wherein the engine has an exhaust purification catalyst, the feedback correction value being a main feedback correction value that is changed according to a concentration of oxygen of exhaust in a section upstream of the catalyst, wherein the controller changes a sub-feedback correction value to cause a concentration of oxygen of exhaust in a section downstream of the catalyst to be equal to a target concentration, and renews, based on a sub-feedback correction value, a sub-feedback learning value used for compensating for a constant deviation of the actual air-fuel ratio from a stoichiometric air-fuel ratio, wherein the controller corrects the main feedback correction value using the sub-feedback correction value and the sub-feedback learning value, and wherein the controller inhibits renewal of the sub-feedback learning value when the feedback correction value is limited to the limit value.

17. A method for controlling fuel injection of an internal combustion engine, the engine having a fuel injection valve, the method comprising:

correcting a fuel injection amount of the fuel injection valve using a feedback correction value to cause an actual air-fuel ratio of an air-fuel mixture burned in the engine to be equal to a target value, the feedback correction value being changed based on the actual air-fuel ratio;

computing a limit value, the limit value being a value of the feedback correction value that causes a fuel injection time of the fuel injection valve to be a permissible minimum time; and limiting a lowest value of the feedback correction value to the limit value when the fuel injection time is less than the permissible minimum time, wherein the feedback correction value includes a proportional term and an integral term, the proportional term being computed based on a difference between an actual fuel injection amount and a theoretical fuel injection amount that is required for an actual air-fuel ratio to be equal to the target value, the integral term being computed based on a process for accumulating the difference at predetermined intervals, and wherein the controller inhibits the process for accumulating the difference when the feedback correction value is limited to the limit value, when limiting a lowest value of the feedback correction value is canceled, the integral term is initialized based on a condition that the integral term has a value that decreases the feedback correction value.

* * * * *